United States Patent [19]

Inge et al.

[11] Patent Number: 4,701,158

[45] Date of Patent: Oct. 20, 1987

[54] CENTRIFUGAL SEPARATOR

[75] Inventors: Claes Inge, Saltsjoe-Duvnaes; Torgny Lagerstedt, Stockholm; Leonard Borgstroem, Bandhagen; Claes-Goeran Carlsson, Tullinge; Sven-Olof Naebo, Tyresoe; Hans Moberg, Stockholm; Peter Franzen, Tullinge, all of Sweden

[73] Assignee: Alfa-Laval Separation AB, Tumba, Sweden

[21] Appl. No.: 922,392

[22] Filed: Oct. 23, 1986

[30] Foreign Application Priority Data

Oct. 30, 1985 [SE] Sweden ..... 8505128

[51] Int. Cl.[4] ..... B04B 1/08

[52] U.S. Cl. ..... 494/74; 494/79; 494/80

[58] Field of Search ..... 494/43, 67, 68, 69, 494/70, 71, 74, 37, 79, 80, 85; 210/782, 781, 360.1

[56] References Cited

U.S. PATENT DOCUMENTS 3,012,710 12/1961 Steinaeker ..... 494/67

3,468,475 9/1969 Thylefors ..... 494/37

3,482,771 12/1969 Thylefors ..... 494/71

3,741,467 6/1973 Valentin ..... 494/70

*Primary Examiner*—Robert W. Jenkins

*Attorney, Agent, or Firm*—Davis Hoxie Faithfull & Hapgood

[57] ABSTRACT

A centrifugal separator has a rotor with an inlet device comprising means forming a receiving chamber that surrounds a stationary inlet tube extending into the rotor. The inlet tube opens into a receiving compartment of the receiving chamber. The receiving chamber also has an induction compartment which surrounds the inlet tube at some distance from its opening.

A deflecting member separates the receiving compartment from the induction compartment and leaves a passage between itself and the inlet tube. Induction members connected with the rotor are operable to induce liquid rotation in the induction chamber radially outside the level of said passage between the deflecting member and the inlet tube, whereas no substantial induction of rotation should take place in the receiving compartment.

8 Claims, 1 Drawing Figure

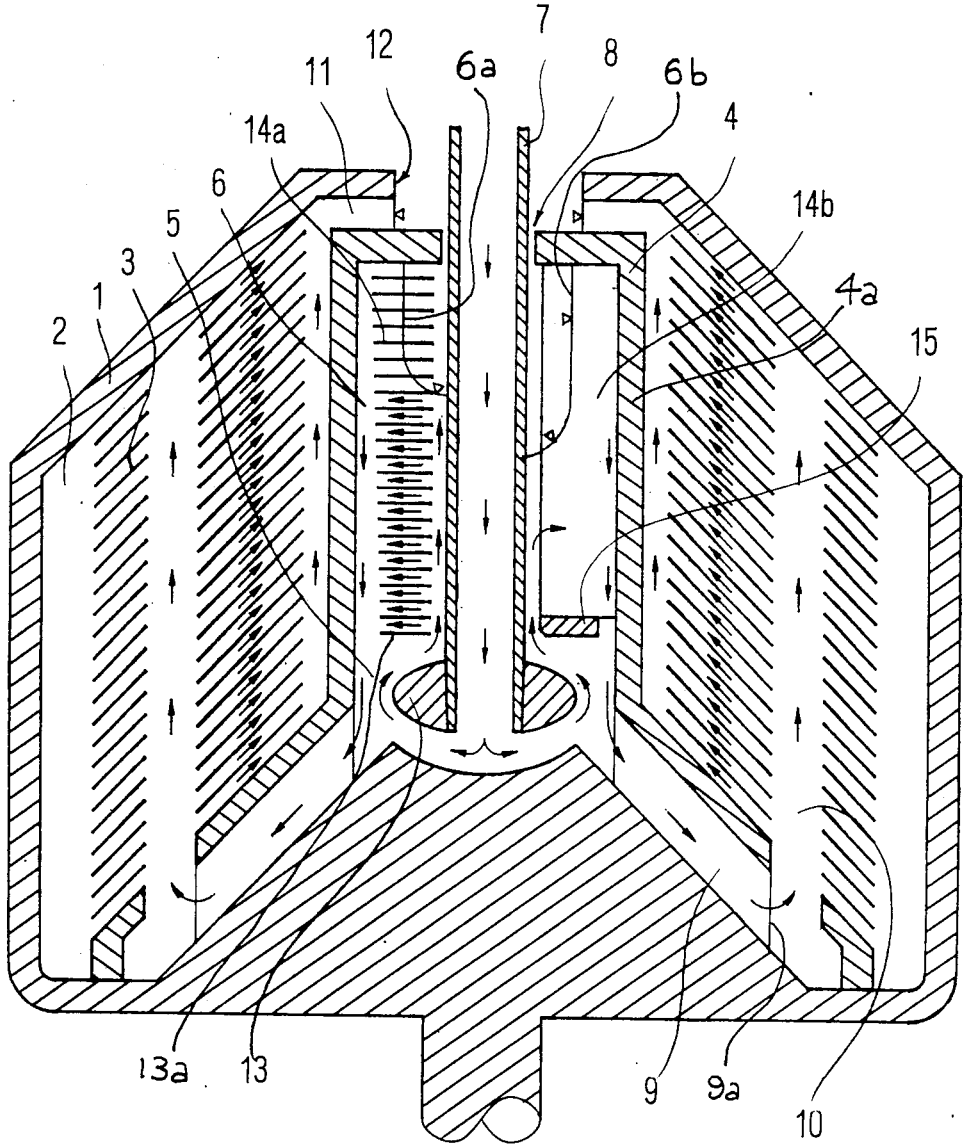
7
12
11
6a
8
6b
14a
4
6
14b
5
3
4a
1
2
15
13a
13
9
9a
10

CENTRIFUGAL SEPARATOR

The present invention relates to a centrifugal separator with a rotor having a separating chamber and a stationary inlet tube for supplying liquid into the rotor. The rotor comprises means forming a central receiving chamber within the rotor, means forming several channels distributed around the rotor axis and connecting the receiving chamber with the separating chamber, and means forming induction members in the receiving chamber for inducing liquid supplied thereto to rotate with the rotor before entering said channels. The stationary inlet tube extends into the receiving chamber and has a supply opening situated in a receiving compartment of the receiving chamber.

A very old problem in connection with centrifugal separators of this kind is how to bring the liquid supplied through the stationary inlet pipe to rotate with the rotor without further splitting or disrupting a dispersed phase of the liquid which is to be separated therefrom in the separating chamber. An effective but smooth and gentle acceleration of the liquid is desired for maximum separation efficiency of the centrifugal separator.

Several solutions to this problem have been suggested over the years, but no one has completely fulfilled the desideratum of being both effective and gentle. The most common kind of entrainment members used in conventional centrifuge rotors comprises radially and axially extending wings which are supported by the rotor in the receiving chamber. Such wings are known to give violent shocks to the incoming liquid and, as a consequence, give rise to large shearing forces therein. They are also known to cause splashing of the incoming liquid and, thereby, to cause air to be mixed with it. However, wings of this kind are still used frequently in spite of their negative effects, which clearly detract from the overall separation efficiency of the centrifuge rotor.

It has been proposed in U.S. Pat. No. 3,468,475 to provide a smooth conical acceleration surface within the receiving chamber of the rotor, facing and surrounding the stationary inlet pipe. The incoming liquid, for instance milk, would flow as a rather thin liquid layer along said surface, without contacting the outside of the inlet pipe, up to a cylindrical liquid surface formed by a body of liquid already rotating in the receiving chamber. Although it has proved in practice that acceleration of a thin layer of liquid in this manner does have some positive effect in connection with milk separation, the same inlet arrangement has proved to have no substantial general positive effect on the overall separation efficiency of the centrifugal separator.

Instead of having a stationary inlet pipe extending relatively far into a centrifuge rotor leaving a clearance thereto in communication with the ambient air, some centrifugal separators have rotors with hermetically sealed inlets. This means that there is a mechanical seal between the rotor and the end portion of a stationary inlet pipe, allowing the interior of the rotor to be filled up with liquid completely. It has proved, in practice, that an inlet arrangement of this kind gives a smoother acceleration of the liquid supplied to the rotor than any open inlet arrangement of the previously discussed kind.

The object of the present invention is to provide an inlet device for a centrifugal separator of the kind having an open inlet arrangement, by means of which acceleration of liquid supplied to the rotor may be accomplished substantially as effectively and smoothly as is obtainable in a centrifuge rotor with a hermetically sealed inlet.

According to the invention, this object is achieved in a centrifugal separator characterized in that induction members are arranged to induce rotation of liquid supplied to the receiving chamber substantially within an induction compartment of the receiving chamber surrounding the stationary inlet tube and separate from a receiving compartment, the receiving compartment being free of members effecting substantial rotation of liquid; that a deflecting member extending around the inlet tube and leaving one or more passages between itself and the inlet tube forms a partition between parts of said receiving and induction compartments situated at the same radial level, i.e. the same radial distance from the axis of the rotor; and that at least the main part of said means forming the induction members is located in the induction compartment radially outside of said passage or passages between the deflecting member and the inlet tube.

By this invention it is possible to maintain in the receiving chamber, at a wide range of flow rates, a body of liquid which contacts the outside surface of the inlet tube and forms with the liquid body still present but moving through the inlet tube, a continuous liquid phase.

Since there are no induction members present in the receiving compartment to cause substantial agitation or splashing of the incoming liquid, the latter is gently accelerated while being caused to move axially towards the induction compartment, at least part of it also being caused to move radially outside of said passage or passages between the deflecting member and the inlet tube. This movement of liquid radially inward, in combination with its relatively small rotation, is intended to create, as in a hydrocyclone, a spinning up effect on the liquid such that when it reaches the passage or passages between said deflecting member and the inlet tube it has a tangential speed of the same magnitude as that of the rotor parts present at this radial distance from the axis. Because it has the same tangential speed as the rotor, the liquid at the relevant radial distance may be brought into contact with induction members rotating with the rotor without encountering violent shocks as in a conventional rotor inlet device.

The said deflecting member may be stationary and supported by the inlet tube. However, in a preferred embodiment of the invention it is supported for rotation with the rotor. An annular passage may be left between a radially inner edge of the deflecting member and the inlet tube, presenting no obstacle at all for passage of the rotating liquid.

The aforementioned channels connecting the receiving chamber with the separating chamber of the rotor may start from any desired part of the receiving chamber. They could thus start from the induction compartment at its end remote from the receiving compartment. Preferably, however, the receiving compartment is located between the induction compartment and the openings of said channels in the receiving chamber, said deflecting member leaving one or more passages between itself and the surrounding wall of the receiving chamber for liquid to flow back to the receiving compartment along said wall.

In an inlet device of said preferred kind the liquid having been accelerated in the induction compartment to substantially the same tangential speed as the rotor near the surrounding wall of the receiving chamber will thus pass through the receiving compartment with this tangential speed on its way to said channels. By having this tangential speed it has a pressure which prevents liquid entering the receiving compartment through the inlet tube, without any rotational movement, from entering said channels. Instead, said entering liquid will be forced to flow axially towards the induction compartment and be deflected by said deflecting member radially inward to the passage or passages formed between the deflecting member and the inlet tube.

The invention will be further described below with reference to the accompanying drawing, which is a schematic view in vertical section of a centrifuge rotor according to the invention.

In the drawing a rotor body 1 forms a separating chamber 2, in which there is arranged a set of frusto-conical separation discs 3. The disc set rests on a lower frusto-conical part of a central member 4 arranged co-axially with the rotor and the disc set. An upper cylindrical part 4*a* of said member 4 extends through the central holes of the separation discs and has, at its top, an annular flange 4*b* extending radially inwardly.

Below said flange within the upper cylindrical part of the central member 4 there is formed a receiving chamber for a liquid mixture to be treated in centrifuge rotor. The receiving chamber has a lower receiving compartment 5 and an upper induction compartment 6. From outside the rotor body 1 through the induction compartment 6 a stationary inlet tube 7 extends into the receiving compartment 5. The opening of the inlet tube 7 is thus situated in the receiving compartment 5 rather close to the lower part of the rotor body 1.

There is a clearance 8 between the inlet tube 7 and the said annular flange 4*b* of the central member 4, forming a communication between the central part of the induction compartment 6 and the atmosphere surrounding the rotor body 1.

From the lowermost part of the receiving compartment 5 several channels 9 extend radially outwardly to the separating chamber 2. The channels 9 are evenly distributed around the common axis of the rotor body 1 and the inlet tube 7. The radially outer openings 9*a* of the channels 9 are situated below and opposite to axially aligned holes in the separating discs 3, forming axial chanr:els 10 through the set of discs 3.

Between the upper side of the annular flange 4*b* of the central member 4 and the uppermost part of the rotor body 1 there are formed one or more passages 11 constituting outlet channels from the separating chamber for a separated relatively light component of the liquid mixture supplied to the rotor. An annular edge 12 of the rotor body 1 forms an overflow outlet for said light component leaving the rotor, and thus controls the positions of the various liquid levels formed within the rotor.

In the receiving compartment 5 the inlet tube 7 is provided with an annular external flange 13.

In the drawing there are illustrated two different alternative induction means arranged in the induction compartment 6 for inducing the supplied liquid mixture to rotate with the rotor.

At the left side of the inlet tube 7 there are shown induction members in the form of several annular discs 14*a* arranged coaxially with each other and with the rotor body 1. The discs 14*a* are spaced axially and may be supported by a number of rods (not shown) suspended from the annular flange of the central member 4 and extending through all of the discs. The bottom disc 13*a* forms an annular partition between the receiving compartment 5 and the induction compartment 6. As can be seen, the radially inner edges of all of the discs 14*a* are equally spaced from the inlet tube 7, whereas—since the outer diameters of the discs 14*a* increase from the bottom disc to the top disc—there is a varying distance between the discs and the cylindrical part of the central member 4.

At the right side of the inlet tube 7 there are shown alternative induction members in the form of radially and axially extending wings 14*b* intended to be evenly distributed all around the inlet tube 7. Supported by the bottom edges of said wings l4*b* is an annular deflecting member 15 extending coaxially around the inlet pipe 7 forming a partition between the receiving compartment 5 and the induction compartment 6. The deflecting member 15 leaves an annular gap between its radially inner edge and the inlet tube 7 and a similar gap between its radially outer edge and the surrounding cylindrical part of the central member 4.

The two different embodiments of the inlet device according to the invention illustrated in the drawing operate similarly and in the following manner:

Liquid mixture supplied through the inlet pipe 7 is conducted by the lower part of the rotor body and the flange 13 radially outward and then axially through the receiving compartment 5 towards the deflecting member 15 (or the bottom disc 13*a*). While flowing this way the liquid mixture is slowly caused to rotate by the friction arising at the contact surfaces between itself and the rotating rotor. Due to the presence of the deflecting member 15 the mixture is forced to flow radially inward while automatically increasing its rotational speed as in a hydrocyclone.

When the mixture reaches the radially inner edge of the deflecting member 15 (or the bottom disc 13*a*), it has substantially the same tangential speed as said edge and as said edge and as the radial inner edges of the wings 14*b* (or discs 14*a*).

Therefore, without being subjected to violent shocks the mixture is brought into further rotation by the wings 14*b* and is conducted under gentle acceleration radially outward between the wings. Reaching the surrounding cylindrical part of the central member 4 the mixture flows axially along this cylindrical part back towards the deflecting member 15. It passes through the annular gap between the deflecting member 15 and the cylindrical part of the central member 4, and enters the radially outer part of the receiving compartment 5. Now rotating with the same speed as the central member 4 the liquid passes axially through the receiving compartment 4 and enters the openings 9*a* of the channels 9. Thence it is conducted to the separating chamber 2.

As to the induction members in the form of discs 14*a*, the interspaces between the discs may be free of any member moving in the circumferential direction. This means that the liquid mixture may be brought into rotation even more gently than by means of radially extending wings. Therefore, it is less important that the mixture, when entering the induction compartment already have a tangential speed substantially as large as that of the radially inner edge of the deflecting member, i.e. the bottom disc 13*a*.

The induction effect of the discs 14*a* is substantially caused by so called Ekman layers formed by the liquid at the surfaces of the discs. Such Ekman layers may be very thin, i.e. in the magnitude of 30–300 for liquids which may be processed in centrifugal separators of this kind. However, due to the fact that solids are often present in the liquid mixtures supplied to a centrifugal separator, the space between adjacent discs will seldom be smaller than 300. A common distance between the discs may be assumed to be between 0.3 mm and 5.0 mm.

Having passed through the interspaces between the discs 14*a*, the liquid mixture rotates with substantially the same speed as the cylindrical inside surface of the central member 4. It thus flows substantially axially in the space between the discs and said cylindrical surface back to the receiving compartment 5, and further through the channels 9 to the separating chamber 2. In both embodiments of the invention there will be formed a free liquid surface within the induction compartment 6, the position of which is dependent upon the flow rate of the liquid supplied through the inlet tube 7. In the drawing there are shown two such positions, 6*a* and 6*b*, of the liquid surface. As is obvious from the drawing, an increased supply flow rate will raise the liquid surface within the induction compartment 5 and thus cause an increased area of the induction members to come into use. This meas that the inlet device is self-controlling and effective at a wide range of supply flow rates.

The various sizes of the discs 14*a* means that whenever another disc interspace is filled up—due to an increased supply flow rate—a further disc 14*a* is used which is somewhat larger than the discs below and, thus, somewhat more effective in its inducement rotation.

The said range of supply flow rates can be extended to very low flow rates by means of a flange like the flange 13 supported by the inlet tube 7. Such a flange prevents splashing of incoming liquid at very low flow rates, and ensures that a coherent liquid body is maintained between the interior of the inlet tube 7 and the inducting compartment 6. In order to impart this effect the flange 13 should have an outer diameter larger than the inner diameter of the aforementioned deflecting member 15 (or the bottom disc 13*a*).

As can be seen from the drawing the openings of the channels 9 in the receiving compartment 5 are located substantially at the same radial level or distance from the rotor axis as the radially outermost parts of the induction entrainment members (14*a*; 14*b*). This is to insure that the accelerated liquid when reaching said openings of the channels 9 has substantially the same tangential speed as the partitions forming the channels 9.

What we claim is:

1. A centrifugal separator having a rotor, a separating chamber in said rotor, a stationary inlet tube for supplying liquid to the rotor, means forming a central receiving chamber within the rotor, said receiving chamber comprising a receiving compartment and an induction compartment, means forming several channels distributed around the rotor axis and connecting the receiving chamber with the separating chamber, induction members for causing liquid supplied thereto to rotate with the rotor before entering said channels, said stationary inlet tube extending into the receiving chamber and having a discharge opening situated in the receiving compartment, said induction members being arranged to induce rotation of liquid supplied to the receiving chamber substantially within said induction compartment, said induction compartment surrounding the stationary inlet tube, and the receiving compartment being free of members effecting substantial rotation of liquid therein, and a deflecting member extending around the inlet tube, there being at least one passage between the deflecting member and the inlet tube, said deflecting member forming a partition between parts of said receiving and induction compartments situated at the same radial level;

at least the main part of said induction members being located in said induction compartment at a level radially outside of said passage or passages between the deflecting member and the inlet tube.

2. Centrifugal separator as claimed in claim 1, wherein said deflecting member is supported for rotation with the rotor, there being an annular passage between a radially inner edge of said deflecting member and the inlet tube.

3. Centrifugal separator as claimed in claim 1 wherein the receiving compartment is located between the induction compartment and the openings of said channels in the receiving chamber, there being at least one passage between said deflecting member and the surrounding wall of the receiving chamber for liquid to flow back to the receiving compartment.

4. Centrifugal separator as claimed in claim 1 wherein the induction members are formed as axially and radially extending wings supported by the surrounding wall of the receiving chamber.

5. Centrifugal separator as claimed in claim 1, wherein induction members are annular discs mounted coaxially with the rotor.

6. Centrifugal separator as claimed in claim 1, wherein said discs are substantially flat.

7. Centrifugal separator as claimed in claim 1, wherein the openings of said channels in the receiving chamber are located substantially at the same radial level as the radially outermost parts of said induction members.

8. Centrifugal separator as claimed in claim 1 and comprising an annular flange supported externally by the inlet tube between its opening and said deflecting member, said flange having an outer diameter larger than the inner diameter of the deflecting member.

* * * * *